US006375530B1

(12) United States Patent
Earl

(10) Patent No.: US 6,375,530 B1
(45) Date of Patent: Apr. 23, 2002

(54) WHALETAIL SWIMMING DEVICE

(76) Inventor: Milan Dennis Earl, 345 E. Main St., Moorestown, NJ (US) 08057

( * ) Notice: Subject to any disclaimer, the term of this patent is extended or adjusted under 35 U.S.C. 154(b) by 0 days.

(21) Appl. No.: 09/774,338

(22) Filed: Jan. 31, 2001

(51) Int. Cl.[7] ..... A63B 31/00
(52) U.S. Cl. ..... 441/55; 441/64; 114/315
(58) Field of Search ..... 114/315; 441/55, 441/60, 64; 440/13, 14, 15, 21, 22

(56) References Cited

U.S. PATENT DOCUMENTS

| | | | | | |
|---|---|---|---|---|---|
| 1,530,560 | A | * | 3/1925 | Heminger | 441/55 |
| 2,042,152 | A | * | 5/1936 | Howland | 441/55 |
| 3,426,722 | A | * | 2/1969 | Dragich | 441/55 |
| 3,987,509 | A | | 10/1976 | Patterman | |
| 4,289,487 | A | | 9/1981 | Fattler | |
| 4,541,810 | A | | 9/1985 | Wenzel | 441/64 |
| 4,867,720 | A | | 9/1989 | Harrington | 441/60 |
| 5,348,503 | A | | 9/1994 | Fechtner | 441/56 |
| 5,401,196 | A | | 3/1995 | Triatafyllou et al. | 440/13 |
| 5,421,758 | A | | 6/1995 | Watson et al. | 441/61 |
| 5,649,845 | A | | 7/1997 | Fechtner | 441/56 |
| 5,820,428 | A | | 10/1998 | Stadler | 441/64 |
| 5,906,525 | A | | 5/1999 | Melius et al. | 441/64 |
| 6,033,276 | A | * | 3/2000 | Han | 114/315 |

FOREIGN PATENT DOCUMENTS

| | | | | |
|---|---|---|---|---|
| FR | 82572 | * | 10/1964 | 440/22 |
| FR | 2616076 | * | 12/1988 | 440/21 |
| GB | 1144305 | * | 3/1969 | 114/315 |

OTHER PUBLICATIONS

1995 Mar. Scientific American Article Mar. 1995 "An Efficient Swimming Machine" by Triantafyllou & Triantafyllou pp. 64–70.

* cited by examiner

*Primary Examiner*—Stephen Avila

(57) ABSTRACT

A flexible elongate support (1) communicating a singular pliable tailfin (2) at an end is made to flap by upward and downward force from a swimmer's legs and midsection, thereby propelling the swimmer and device in a forward direction. The swimmer inserts legs into rearward lever element (3) and forward cradle (6) which adjustably communicate with elongate support (1) at locations substantially aligning with the feet and thigh areas of a swimmer longitudinally juxtaposed to the device and provide pivot locations about which the swimmer's legs use leverage to forcibly cause tailfin (2) to displace sequentially upward and downward. Flexible elongate support 1 provides a recoil restoring force when distorted from equilibrium during a stroke, which increases efficiency and assists the swimmer in causing tailfin (2) to flap in a manner similar to the action of aquatic creatures such as dolphins and whales.

16 Claims, 10 Drawing Sheets

WHALETAIL SWIMMING DEVICE

BACKGROUND OF THE INVENTION

Human-powered movement through water has always been a challenge. Because of constraints presented by body characteristics which are designed for motion on land, humans can only envy the smooth and graceful propulsion methods of aquatic creatures. Through the use of swimming aids such as attachable fins and paddles, men have attempted to increase ease and speed of motion through water. These efforts to improve efficiency in human-powered swimming have had only limited success.

Devices such as described in prior art U.S. Pat. Nos. 4,289,487, 4,867,720, and 5,421,758 are complicated and tend to need unnatural or difficult actions by the swimmer. Improving fin design, or utilizing paddles such as in prior art U.S. Pat. Nos. 3,987,509, 4,541,810, 5,348,503, 5,649,845, and 5,820,428 are only moderately successful in facilitating human motion through water. By increasing the surface area which reacts with water, the effort of the swimmer becomes more effective. This is an underlying principal presented by virtually all of the prior art.

Extending and Positioning of swimming aids such as attachable fins may be as important as their design and size. Prior art U.S. Pat. Nos. 5,906,525 and 5,421,758 somewhat describe extension and location of the surface area of a fin out from the foot, but utilization of this leverage-gaining characteristic is minor compared to that leverage gained by the instant invention.

Constraints in the human anatomy, beside an obvious lack of surface area which reacts with water, include inappropriate leverage and a generally incompatible hinging of many body joints for necessary movements in water. The knee, for example, is hinged substantially in a posterior/anterior manner, making side to side motion uncomfortable and difficult. A design employing such an unnatural movement for tailfin power is shown in prior art U.S. Pat. No. 5,348,503. The human, therefore, is limited in options as far as the design for viable operation of assisting devices for swimming.

The structure of the entire human body lends itself best to producing forces toward the front and back, rather than side to side. An aid to propulsion is best designed in a compatible orientation. Common swimming gear, such as foot fins and paddles enhance the effects of the natural action of kicking and arm rotation for water movement. Although design features for these items improve results, they have shown to have only limited effectiveness. The instant invention also uses the natural movement associated with humans to provide the force necessary for water movement, but in a more effective and efficient manner.

A device which mimics the design of aquatic creatures and effectively merges such design with the limitations of the human anatomy is presented herein. As described in the referenced 1995 Scientific American article "An Efficient Swimming Machine", many fishes and sea mammals are propel efficiently utilizing primarily their singular tailfins. Referenced prior art U.S. Pat. No. 5,401,196 by the same author teaches the utilization of such tailfins for propulsion, and explains advantages to be gained. Vortices produced by tailfin strokes produce interactions with subsequent strokes and thereby increase efficiency to a degree not yet achieved by human water propulsion devices. Evolution has shown this principle to be effective, evidenced by the multitude of organisms using tailfins. Although many fishes stroke their tailfin horizontally, others are successful stroking in a vertical manner. Sea mammals such as whales and dolphins, believed to have evolved from land animals, utilize this vertical stroking motion, probably because it conforms most directly to their land-based anatomy. Since vertical stroking seems to present no disadvantage to survival, these animals have not needed to evolve further to a horizontal stroking orientation.

Because man is a land animal, it follows that the human anatomy conforms best to the principles of movement utilized in water by whales and dolphins. The instant device provides a marriage of the structure of the human body with these principles. Since singular tailfin action is extremely efficient, it is the underlying principal of the invention, and human legs provide the strength for thrust. Because people are designed for walking and running, leg action on humans is stronger than for other body parts, and the legs can last for longer periods under physical stress. Leg strength, along with lever action and restoring resilience of the device, provide a new and effective method for aiding in efficient human-powered movement through water.

By utilizing principles of leverage in conjunction with a design which matches well with that of the human anatomy, this device aids in increasing the speed, ease and efficiency by which a person may move both above and below the surface of the water. It is of simple design, and may be constructed with materials available at present. An elastic elongate structure which provides a springboard restoring force, unprecedented in the prior art, differentiates the instant invention from prior art. A flexible structure is an important component in mimicking the flapping action of aquatic creatures, which use a resilient backbone to accomplish the same feat. This unique feature not only provides structure, but is essential to the operation. It may be composed of an elastic substance such as metallic spring, plastic, or composite material available today. Elasticity supplies a restoring recoil force when distorted, thereby facilitating the user's subsequent tailfin stroke. Successive strokes are therefore more easily and more quickly performed. Prior art U.S. Pat. No. 4,867,720 teaches a device which is firmly attached to the legs and supplies resilience to assist a swimmer in normal swimming activity. This prior art does not have many of the advantages of the instant device, in that it is merely an attachment to the legs, affects the efficiency of the swimmer only in the leg area, cannot be utilized on a singular fin without presenting unobvious redesign problems for comfort and efficiency, and does not address the novel combination presented in the instant invention. The elasticity presented in this prior art is confined strictly to the knee area and therefore affords little mechanical advantage compared with the instant invention. Because the hips are pivotable, the elastic supplement described is not secured at an end to form a springboard, and effectiveness is severely curtailed.

By longitudinal adjustment of forward and rearward leg levering means, a comfortable and efficient match for virtually all human dimensions may be attained. The longitudinal positioning of the tailfin is another adjustment which affects the performance of the assemblage. By extending the fin, the lever action of the device is altered, varying performance. Therefore, by making the components of the invention longitudinally adjustable, an ideal configuration for a particular user may be acquired.

Many variations to the design of the invention are possible, depending upon the needs of the swimmer. For underwater diving purposes, the buoyancy of the device may ideally be neutral with respect to water. Adjustable buoyancy is a possibility for certain purposes and a variety of methods could be used. Cushioning may be advantageous at locations throughout the device in order to prevent abrasion to the swimmer caused by repetitive motions and contact with parts of the device. These protective cushions also provide buoyancy if needed, using materials such as styrofoam to accomplish both tasks.

The independent nature of the device is a major variation from the prior art. By simply straddling the device in a longitudinal manner and inserting legs and feet into the appropriate leverage elements, the user is instantaneously prepared to accelerate. There is no need for strapping, tying, or binding the invention in any way, as opposed to requirements presented in virtually all prior art. In addition, separation of the swimmer from the device is accomplished simply by reversing the process, allowing for quickness and safety. Essentially, the user may swim into or away from the invention when desired.

Obviously, the novel nature of the instant invention opens a variety of possibilities for its design and use.

BRIEF SUMMARY OF THE INVENTION

This invention relates to devices which improve human motion through water. The object of this invention is to provide a simple, efficient and fast method for human-powered movement through water. It may be used both on the surface and under water for recreational or working purposes. A bendable elongate member having a large fin at a rearward end is longitudinally mounted by a swimmer whose legs are thereafter inserted into at least two communicating leverage elements. The legs and device therefore substantially form a class III type lever to act upon the fin, while the torso stabilizes the forward portion of the flexible elongate member to effectively produce a springboard. The swimmer employs a repetitive pumping motion with his/her legs thereby displacing the fin successively upward and downward and causing forward motion in a manner similar to whales and other aquatic creatures. Recoil force stored in the flexed elongate member substantially form a springboard action and aid the swimmer in sequential strokes. Adequate flotation and padding are applied as necessary for comfort, control, and mounting purposes.

DESCRIPTION OF THE INVENTION

Figure 1:
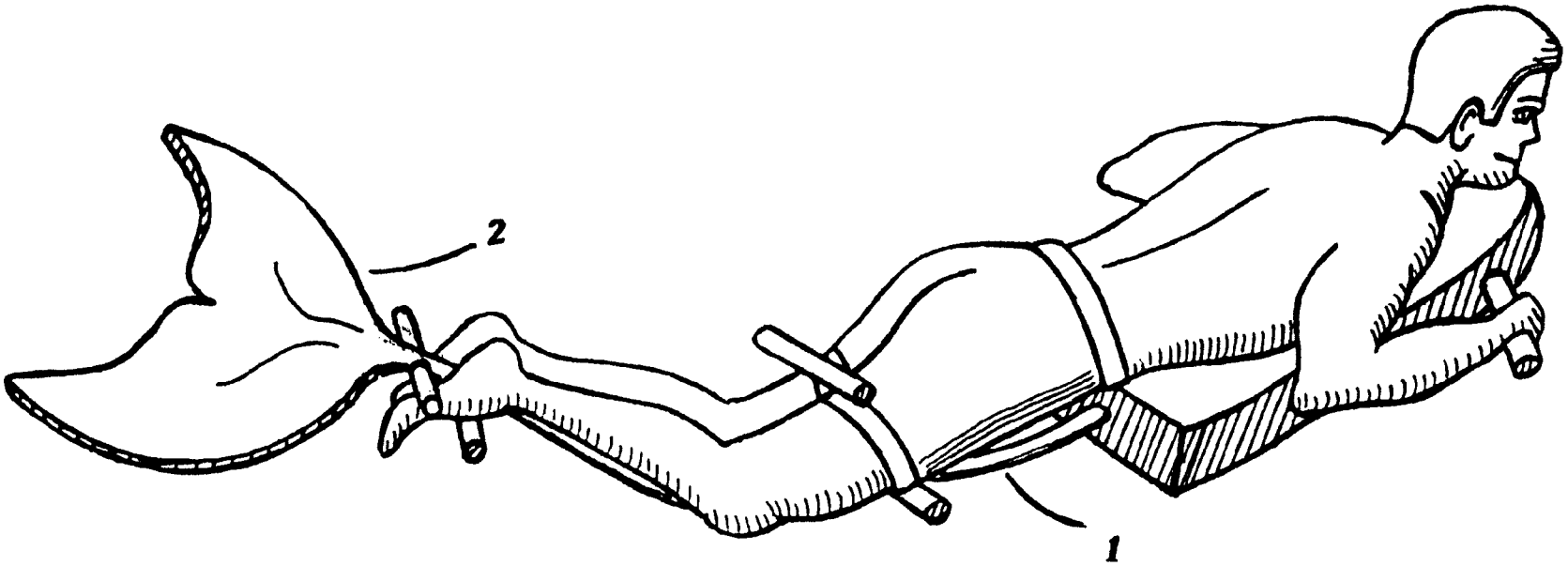
FIG. 1 shows a preferred embodiment of the device being used for propulsion by a swimmer.

FIG. 1 illustrates a preferred embodiment of the instant invention being used by a swimmer. Elongate support 1 has a large singular tailfin 2 attached at an end. Tailfin 2 is pliable and has a large surface area which reacts with water and thereby propels the swimmer forward during strokes. Elongate support 1 is flexible and provides a restoring force when distorted during a stroke, much like a springboard or diving board, thereby assisting on a subsequent stroke in an opposite direction and facilitating the creation of a sequential flapping motion. Elongate support 1 may be constructed of any suitable pliable material such as plastic, composite, wood or metal having the necessary strength and resilience to withstand repetitive strokes of tailfin 2. Herein illustrated as a tubular structure, elongate support 1 may have other geometric forms which provide the necessary characteristics for operation of the device. Although elongate support 1 may be flexible upon its entire length, it is may be flexible substantially only in the portion in which levering action takes place. This also allows for a hinged embodiment to be described later.

Figure 2:
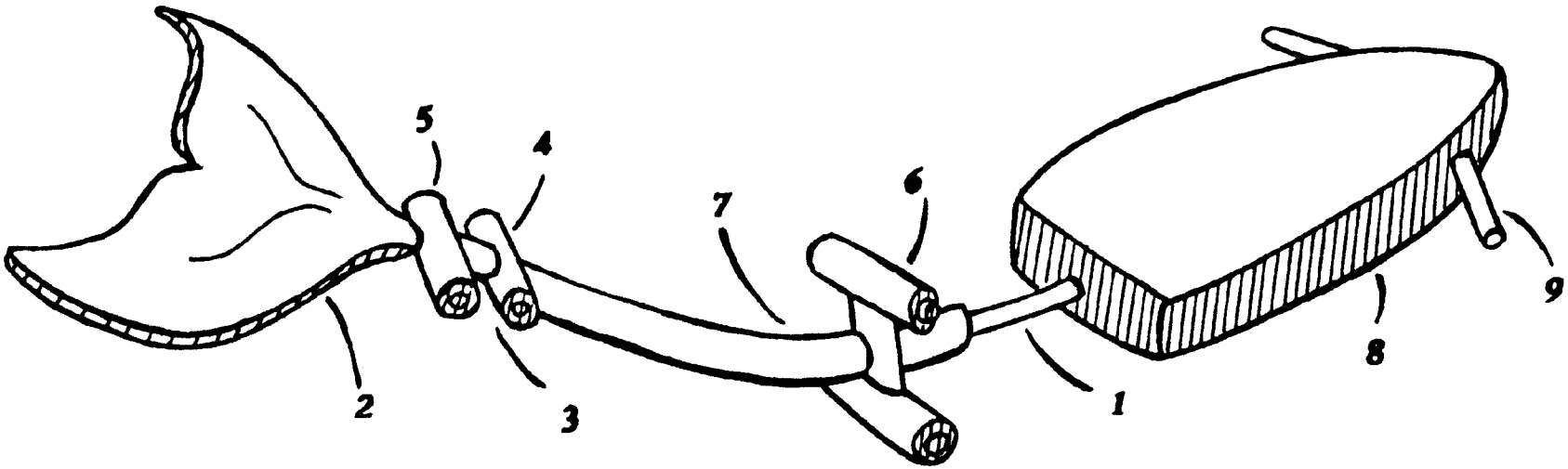
FIG. 2 shows an embodiment of the device without the swimmer.

FIG. 2 shows a preferred embodiment of the device without a swimmer. Tailfin 2 is longitudinally adjustable to increase or decrease leverage as desired. Rearward lever element 3 provides a means for rearward leverage and is comprised of two horizontal projections extending from elongate support 1 into which feet may be easily and comfortably inserted, and which provide contact area by which the swimmer may force tailfin 2 either downward or upward. During a downward stroke, the instep of the swimmer's foot reacts with front projection 4 of rearward lever element 3, and during an upward stroke the bottom of the swimmer's foot reacts with back projection 5 of rearward lever element 3. Although rearward lever element 3 is illustrated herein as having horizontal projections from elongate support 1, several angles and designs are possible to provide the necessary comfort and contact for leverage near tailfin 2. Other embodiments are described below. It will be noted that in the embodiments presented herein the legs and feet may be extracted easily and quickly for safety. A swimmer may virtually swim out of the device.

Forward cradle 6 is comprised of an H-shaped tubular structure aligned substantially centrally to the swimmers length, also termed herein the midsection, and oriented vertically into which the swimmer inserts his/her upper legs to provide a means for leverage in both downward and upward tailfin strokes. Forward cradle 6 communicates with elongate support 1 and is longitudinally adjustable to accommodate people of different sizes and to allow for desired leverage. Rearward lever element 3 and forward cradle 6 are substantially positioned longitudinally to correspond to the foot area and the midsection area of a swimmer juxtaposed longitudinally to the device. When tailfin 2 is flapped, forward cradle 6 approximates the fulcrum of a class III lever and rearward lever element 3 approximates the effort for a class III lever in both the up stroke and the down stroke. A class III type lever is best described by the action of a swung baseball bat, wherein the fulcrum is at an end, work is accomplished at an opposing end, and the effort is applied between the two.

Protective padding 7 is applied to various areas of the device to prevent skin abrasion because movement through water utilizing the instant device requires repetitive action of the body in contact with portions of the device. Soft materials such as foam rubber and styrofoam serve this function and also increase buoyancy. A certain buoyancy facilitates mounting of the device.

Flotation segment 8 supplies necessary buoyancy for balance, allows easy mounting, and prevents possible loss through sinking. Flotation segment 8 is streamlined for free flow of water over the surface, hereby producing less resistance to forward motion. Handles 9 enable swimmer to balance and control the device. Additionally, handles 9 may provide lateral flotation which stabilizes the device during turns and in turbulent water, preventing rollover, Turning the device is accomplished by a shift of body weight while moving.

The device is ready for immediate use simply by straddling elongate support 1 and inserting legs horizontally into forward cradle 6 and feet into rearward lever element 3. By utilizing lever action, the swim is able to pump his/her legs up and down in a dolphinlike manner and thereby cause tailfin 2 to flap and propel the device and swimmer in a forward direction. The flapping pattern of a swimmer using the invention is similar to the common butterfly swim stroke, except that the up and down movement of the torso and head are reduced because lever elements 3 and 6 confine most of the movement to the legs. By holding handles 9 firmly, swimmer stabilizes the forward portion of flexible elongate support, substantially forming a springboard which creates a restoring force when the rearward end is distorted from equilibrium by the legs. Potential energy is released to assist in a subsequent stroke in the opposite direction, thereby making the device more efficient.

Figure 3:
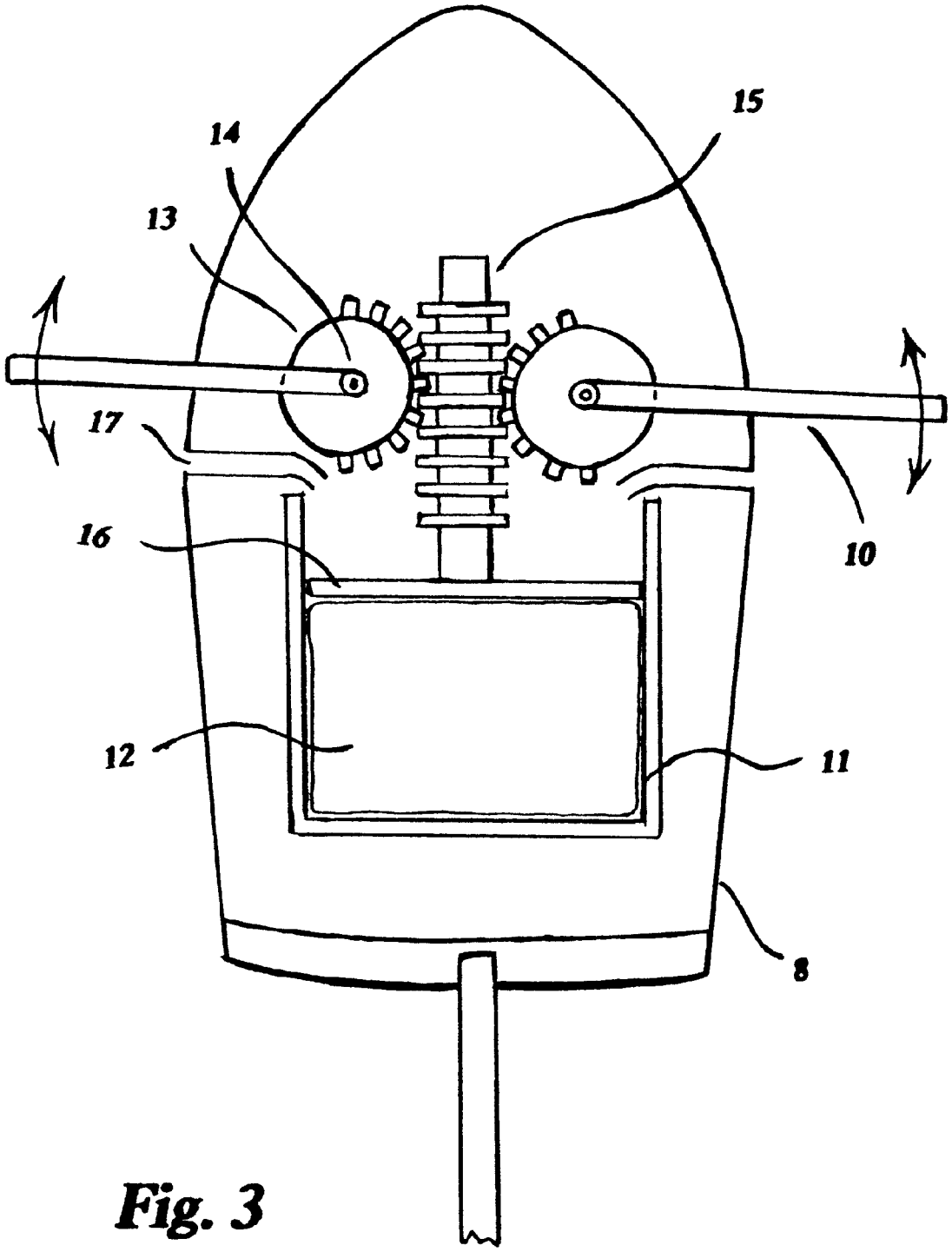
FIG. 3 shows an overhead cutaway view of an embodiment of an adjustable flotation.

Adjustable flotation is desirable if the device is to be used for underwater activities. FIG. 3 illustrates a cut away overhead view of one design which allows for variable floatation, although many designs are possible. Rotatable handles 10 are located on flotation segment 8 having a cavity 11 containing an airtight bladder 12. By forcing rotatable handles 10 forward, toothed wheels 13 are rotated around axle 14 while simultaneously engaging toothed piston rod 15 and forcing it inward. Toothed piston rod 15 communicates at an end with compressing piston 16, thereby forcing it into cavity 11 compressing airtight bladder 12. Water is allowed entry during compression of airtight bladder 11 through entry passages 17, thereby replacing air with water, and lowering the overall density of the device. This causes the device to lose buoyancy and facilitate diving. The process is reversible, allowing the diver to lower the overall density and therefore increase flotation in order to rise. In this manner buoyancy is adjustable for both surface and underwater movement. Ideal total buoyancy is also dependent upon the buoyancy of the swimmer, so flotation is adjustable through a range of values.

Figure 4:
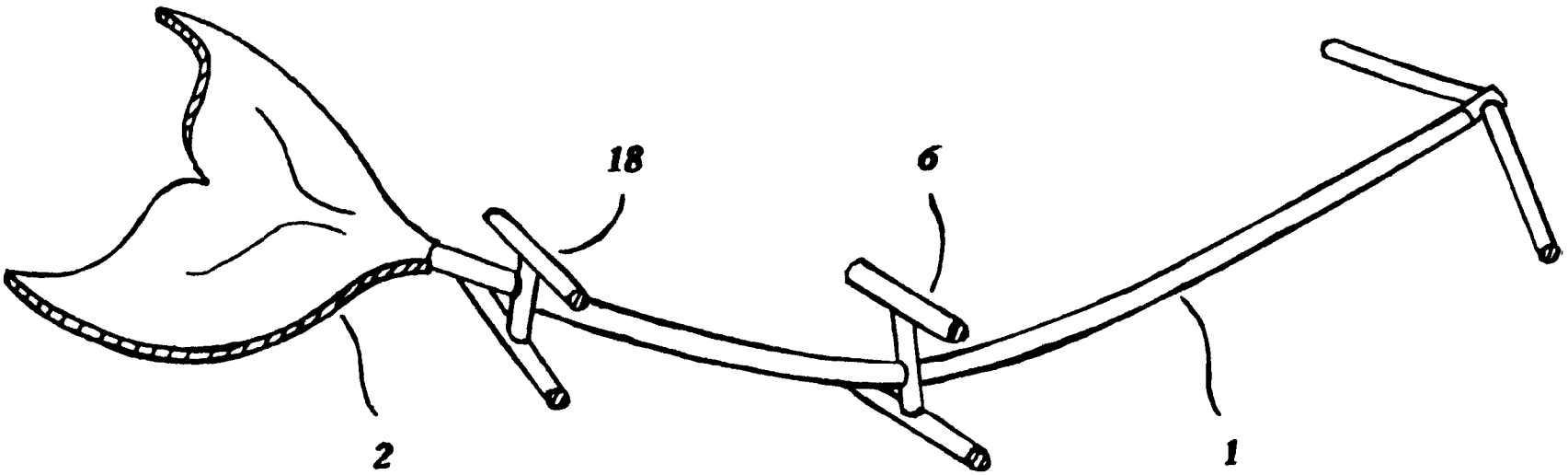
FIG. 4 shows an embodiment of the device having a minimum of components.

FIG. 4 illustrates a simplified embodiment of the invention wherein it is comprised of a pliable elongate support 1 having a large singular tailfin 2 at an end and forward lever cradle 6 and rearward lever cradle 18, which provide means for obtaining leverage Rearward lever cradle 18 is herein illustrated as having an H-shape, horizontally oriented into which the swimmer inserts his/her ankles. In this embodiment, the device has virtually neutral buoyancy and underwater positioning is dependent upon the swimmer's flapping and body shifting.

Figure 5:
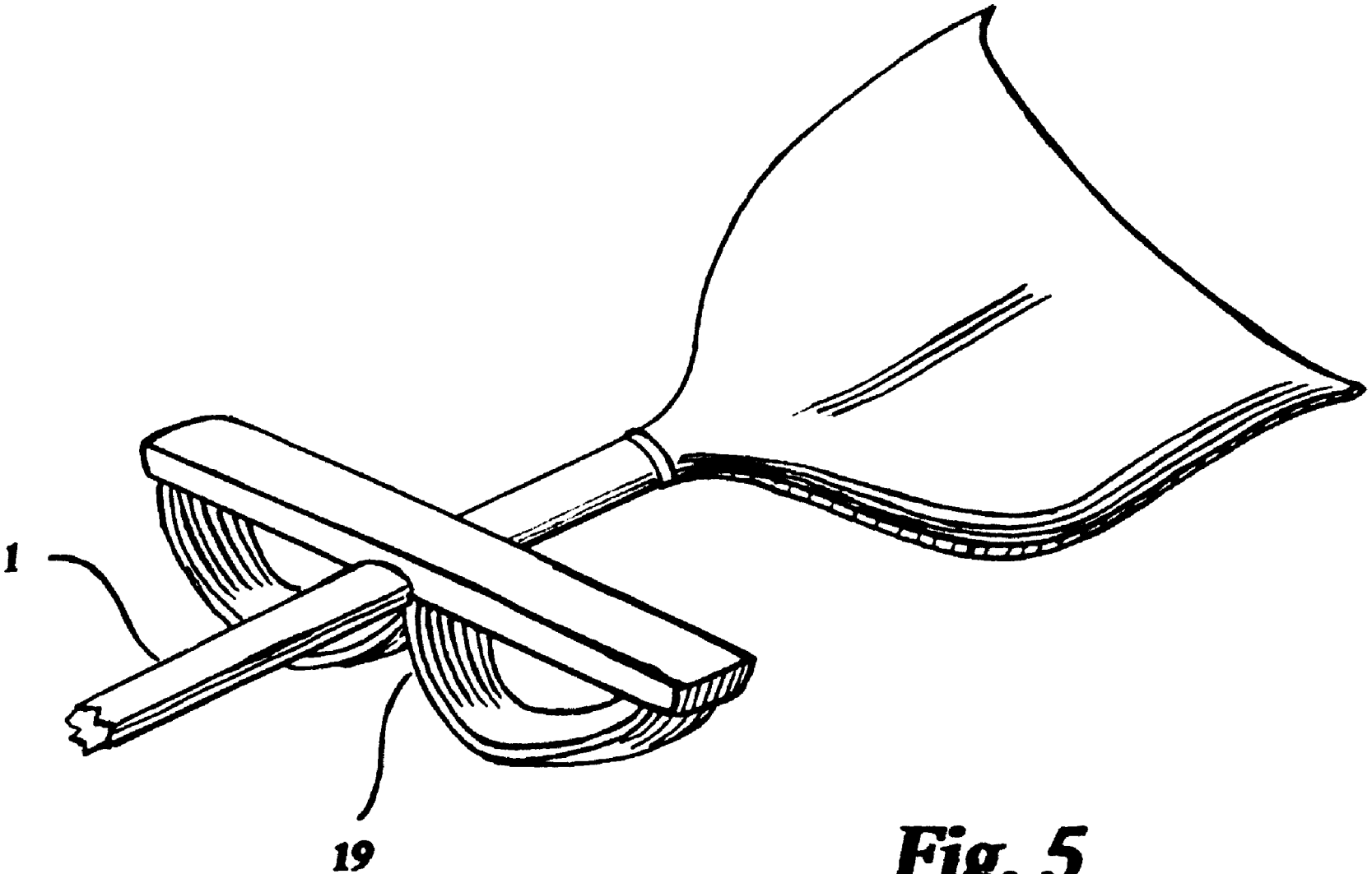
FIG. 5 shows an embodiment for a rearward lever element which employs pockets for the insertion of feet.

FIG. 5 illustrates an embodiment of a pocket rearward lever element 19 which is affixed to elongate support 1. Pocket rearward lever element 19 is constructed with a strong but comfortable clothlike material in order that the feet of the swimmer may be inserted and remain comfortable during stroking.

Figure 6:
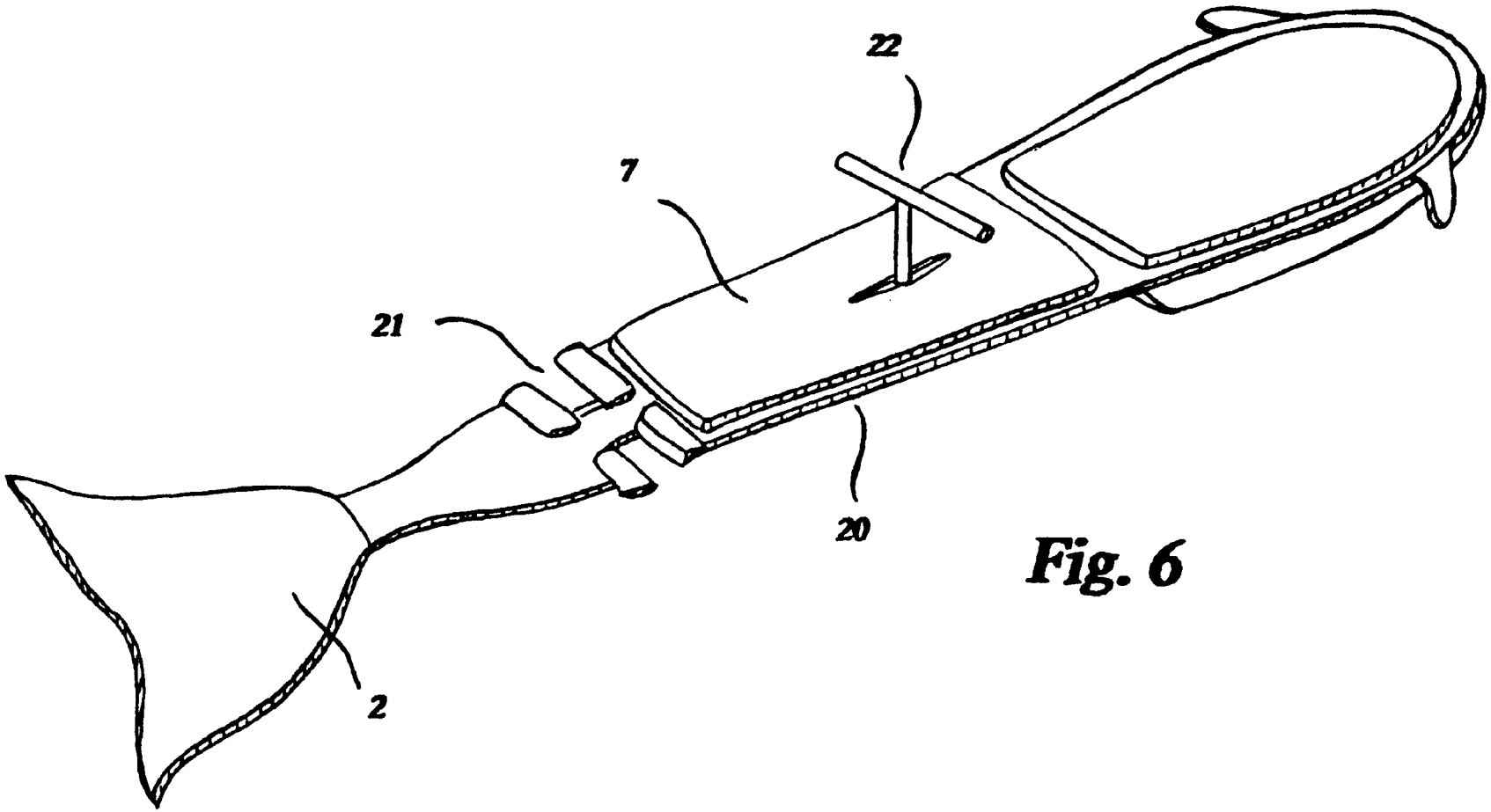
FIG. 6 shows an embodiment employing a flat pliable material, a flexboard.

An embodiment of the instant invention is illustrated in FIG. 6 in which a flexboard 20 is of sufficient width to allow the legs of a swimmer to lay atop, while fitting his feet into foot slots 21. Flexboard 20 is constructed of a thin resilient material which may be distorted vertically and therein produce the recoiling force which can be used in a fishtail motion as described previously. Foot slots 21 act in conjunction with T-cradle 22 to produce a lever action which creates whalelike motion. The required leverage is supplied when raising tailfin 2 by use of the bottom of the feet on the rearward portion of foot slots 21 and the upper legs against flexboard 20 itself. Leverage is supplied on the downstroke by action of the foot instep of the swimmer against the forward portion of foot slots 21 and T-cradle 22 located at a comfortable position behind the upper leg. Protective padding 7 serves the same purpose as previously described, and is especially necessary on the surface of flexboard 20 to prevent abrasion to the swimmer during extensive use.

Figure 7:
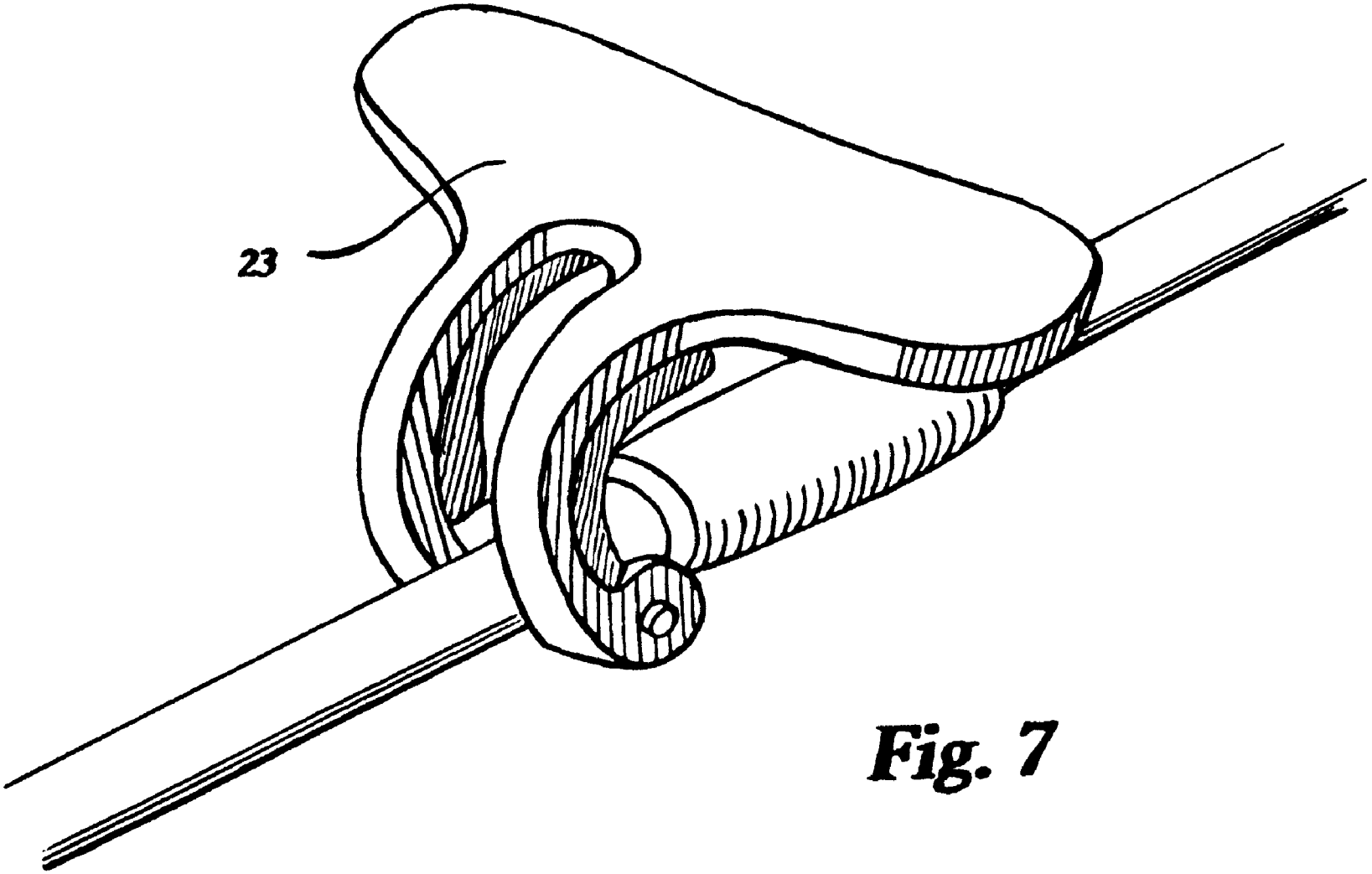
FIG. 7 shows an embodiment of forward lever element which employs a retractable saddle to stabilize the lower body and upper legs of the swimmer and act as a fulcrum.

An embodiment of a lever component is shown in FIG. 7 wherein retractable saddle 23 is utilized to provide a pivot for lever action in the device. It may be used as an alternative leverage design in conjunction with the various other embodiments of the device. Because the swimmer essentially sits in saddle 23, appropriate padding is necessary for comfort. It may be noted that obvious embodiments of a forward lever element may be also located in the torso area of the swimmer. Such embodiments, while increasing the length of the lever arm, may or may not facilitate movement.

Figure 8:
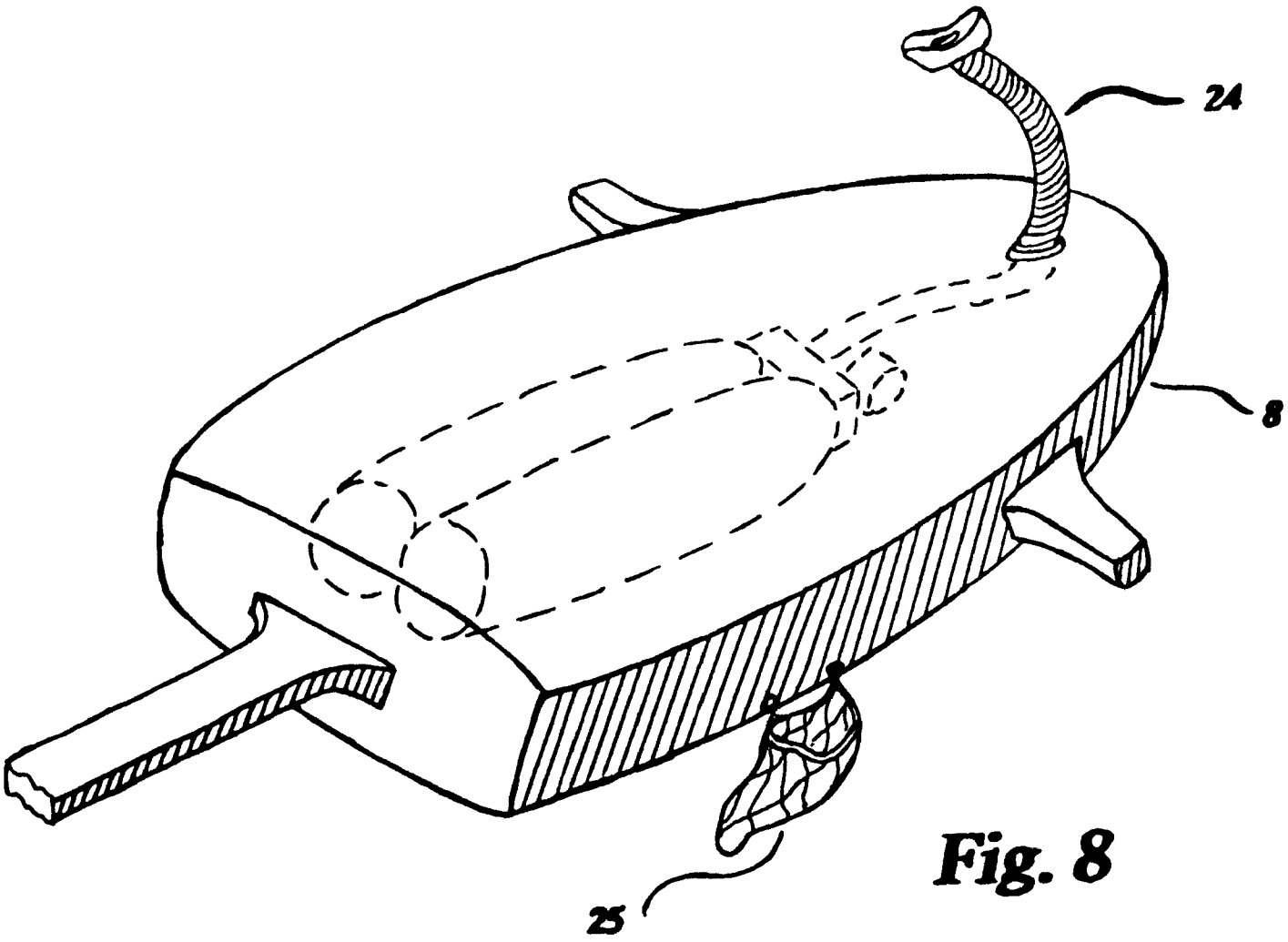
FIG. 8 shows a flotation segment having an internal underwater breathing apparatus.

A design embodiment for flotation segment 8 is illustrated in FIG. 8, which has incorporated within its structure a refillable underwater breathing device similar to conventional scuba gear. Hose and mouthpiece 24 extending from flotation segment 8 are used by the swimmer while diving. The swimmer may actually leave the device for short periods, if the situation is warranted. Since this swimming aid produces faster and more efficient underwater travel, such an embodiment allows for a more extensive exploration during dives This embodiment eliminates the need for heavy, cumbersome, and uncomfortable scuba gear. Carrying pouch 25 and similar attachments also increase convenience.

Figure 9:
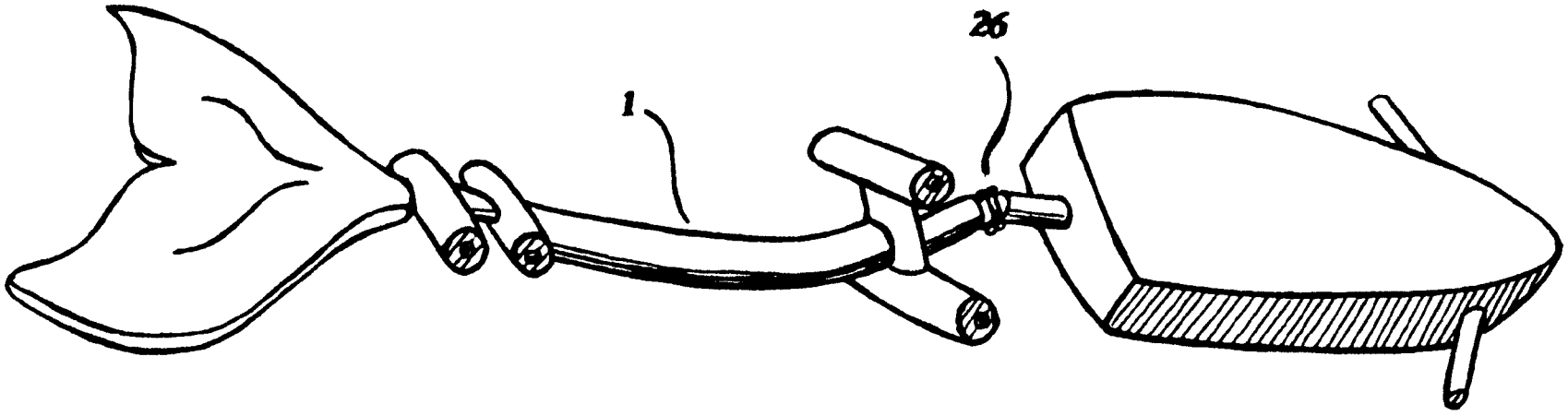
FIG. 9 shows a hinged embodiment of the device.

Employing a hinged or ball and socket design as shown in FIG. 9 varies leverage and allows portability. Hinge 26 insures elongate support 1 is bendable both upward and downward and may optionally be spring-loaded. It may be noted that this embodiment may reduce total flexure and all action is substantially confined to the leg area.

Figure 10:
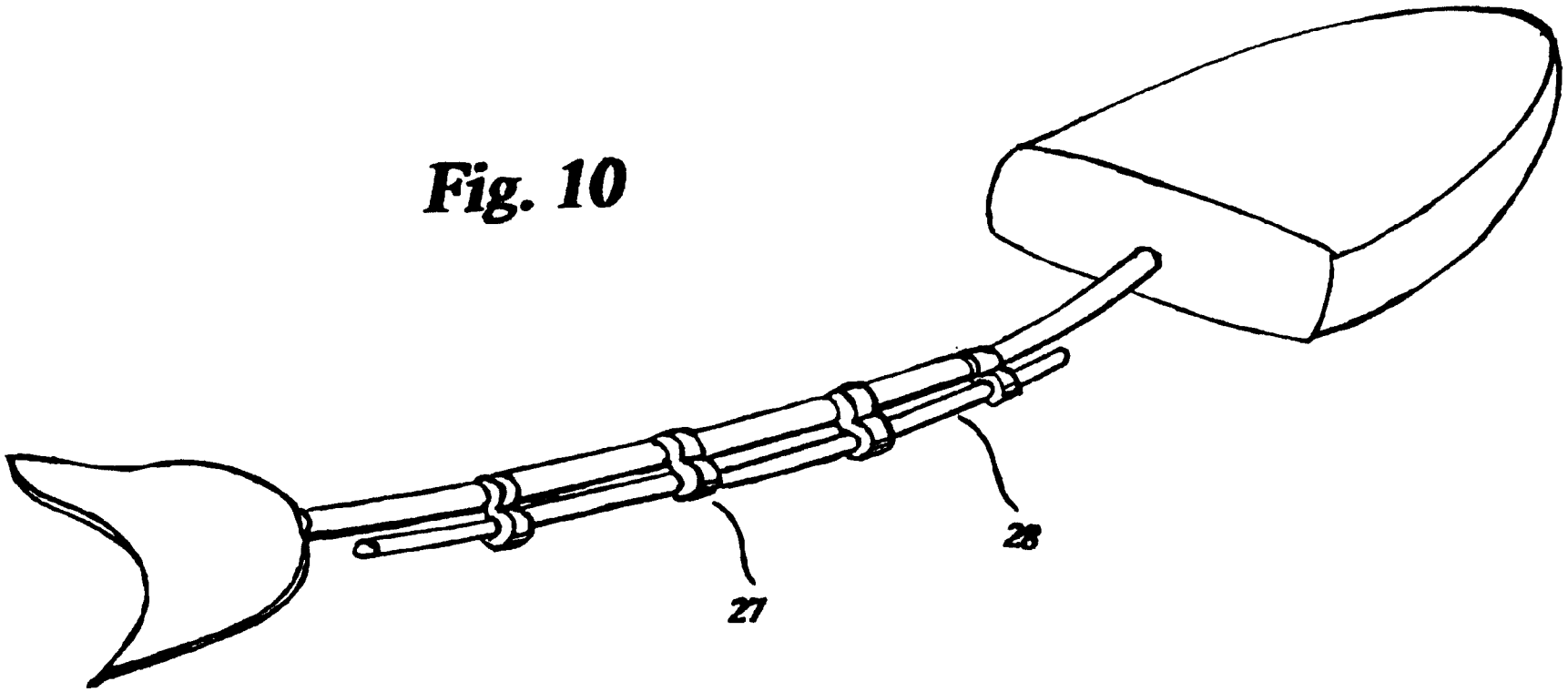
FIG. 10 shows a method whereby the elasticity of the elongate support stucture may be adjustable.

FIG. 10 illustrates a simple means whereby elasticity of the elongate support structure 1 may be adjusted to accommodate different needs. Elongate support structure 1 has multiple attaching elements 27 through which flexible elongate supplement 28 is longitudinally inserted to provide additional resilience to the device as desired. By varying either the composition of flexible elongate supplement 28 or attaching more than one of these supplements, the swimmer may adjust the flexure of the device to his/her particular needs. Flexible elongate supplement 28 is herein described as being pressure-fitted to hold in place during use. For use in a flexboard situation, a sliding flexible member could be inserted into rectangular brackets and serve the same purpose as described herein.

Further improvements on the device are conceivable, including:

- using springs, such as a singular large elongate central spring to supply elasticity for the lever action in elongate support 1;
- attaching brackets or other connecting means to flotation segment 8 for purposes of carrying materials, or attaching separate items such as scuba tanks;
- utilizing a pump to provide necessary pumping for adjustable buoyancy in flotation segment 8.

Although the descriptions herein contain many specificities, these shold not be construed as limiting the scope of the invention but as merely providing illustrations of some of the presently preferred embodiments of the invention thus the scope of the invention should be determined by the appended claims and their legal equivalents, rather than by the examples given.

I claim:

1. A device to aid in human propulsion through water comprising:

a. bendable elongate support means in communication with at least one fin at a rearward end, b. at least one forward levering means in communication with said elongate support means at a longitudinal location substantially aligning and corresponding with a middle body area of a swimmer positioned longitudinally astride said elongate support means, c. at least one rearward levering means in communication with said elongate support means at a longitudinal location between said at least one forward levering means and said at least one fin and substantially aligning and corresponding with a foot and ankle area of said swimmer positioned longitudinally astride said elongate support means, whereby said swimmer may longitudinally engage said device by engaging said at least one forward levering means with said substantially corresponding middle body area and engaging said at least one rearward levering means with said substantially corresponding foot and ankle area and thereafter apply force substantially in a direction perpendicular to said elongate support means against said at least one forward levering means and said at least one rearward levering means thereby displacing said at least one fin in a sequential upward and downward flapping manner and thereby propel said device and said swimmer forward.

2. The device of claim 1 wherein said elongate support means is flexible for at least part of its length wherein said elongate support means applies an opposing restoring force when distorted from equilibrium thereby assisting in said flapping of said at least one fin.

3. The device of claim 1 wherein a flotation means is communicated at a substantially forward end of said elongate support means whereby said device becomes at least partially buoyant.

4. The device of claim 3 wherein said buoyancy of said flotation means is adjustable.

5. The device of claim 1 wherein grasping means are communicated with said elongate support means.

6. The device of claim 1 wherein at least one of said at least one fin, said at least one rearward levering means, and said at least one forward levering means adjustably communicates longitudinally with said elongate support means.

7. The device of claim 1 wherein said elongate support means is comprised of a substantially flat, pliable material.

8. The device of claim 1 wherein flexibility of said elongate support means is adjustable.

9. The device for aiding human propulsion in water comprising:

a. bendable elongate support means having at least one tailfin communicated at a distal end, b. at least one rearward levering means located a distance proximally from said at least one tailfin, c. at least one forward levering means located a distance proximally from said rearward levering means, whereby a swimmer positioned longitudinally astride said elongate support means communicates corresponding body parts with said at least one forward levering means and said at least one rearward levering means and thereafter applies force substantially in a direction perpendicular to said elongate support means on said at least one forward levering means and said at least one rearward levering means in a sequential upward and downward manner causing said at least one tailfin to flap and thereby causing swimmer and said device to be propelled forward.

10. The device of claim 9 wherein said elongate support means is flexible for at least part of its length and said elongate support means applies an opposing recoil force when distorted from equilibrium.

11. The device of claim 9 wherein buoyancy means is communicated substantially at a proximal end of said elongate support means.

12. The device of claim 11 wherein buoyancy of said buoyancy means is adjustable.

13. The device of claim 9 wherein grasping means are communicated with said elongate support means.

14. The device of claim 9 wherein at least one of said at least one tailfin, said at least one rearward levering means, and said at least one forward levering means is in adjustable communication longitudinally with said elongate support means.

15. The device of claim 9 wherein said elongate support means is substantially flat and substantially as wide as a human body.

16. The device of claim 9 wherein said elongate support means is flexibly adjustable.

* * * * *